US008845392B2

(12) United States Patent
Butler et al.

(10) Patent No.: US 8,845,392 B2
(45) Date of Patent: Sep. 30, 2014

(54) ARRANGEMENT FOR GRINDING AND A METHOD THEREOF

(75) Inventors: Shane Butler, Lincoln (GB); Gordon Lanes, Sleaford (GB)

(73) Assignee: Siemens Aktiengesellschaft, Munich (DE)

( * ) Notice: Subject to any disclaimer, the term of this patent is extended or adjusted under 35 U.S.C. 154(b) by 930 days.

(21) Appl. No.: 12/469,049

(22) Filed: May 20, 2009

(65) Prior Publication Data

US 2009/0291622 A1 Nov. 26, 2009

(30) Foreign Application Priority Data

May 21, 2008 (EP) ..... 08009405

(51) Int. Cl.

| | |
|---|---|
| ***B24B 1/00*** | (2006.01) |
| ***B24B 51/00*** | (2006.01) |
| ***F01D 5/30*** | (2006.01) |
| ***B24B 19/00*** | (2006.01) |

(52) U.S. Cl.

CPC ..... *B24B 19/009* (2013.01); *F01D 5/3007* (2013.01); *F05D 2230/10* (2013.01)

USPC ..... 451/27; 451/178

(58) Field of Classification Search

USPC ..... 451/57, 54, 55, 24, 178; 29/889.2

See application file for complete search history.

(56) References Cited

U.S. PATENT DOCUMENTS

| | | | | |
|---|---|---|---|---|
| 1,614,558 | A * | 1/1927 | Kasley | 409/131 |
| 5,430,936 | A | 7/1995 | Yazdzik, Jr. et al. | |
| 6,935,817 | B2 * | 8/2005 | Sasu et al. | 409/132 |
| 7,007,382 | B2 * | 3/2006 | Mantel | 29/889.2 |
| 7,303,461 | B1 * | 12/2007 | Campomanes et al. | 451/28 |

FOREIGN PATENT DOCUMENTS

| | | | | |
|---|---|---|---|---|
| GB | 2435440 | A * | 8/2007 | B24B 19/00 |
| WO | WO 2007/096295 | A1 | 8/2007 | |

* cited by examiner

*Primary Examiner* — Dung Van Nguyen

(57) ABSTRACT

An improved grinding arrangement for grinding a required profile in a body is provided. The arrangement includes a body having at least one channel extending into the body and a grinding wheel adapted to grind the required profile in the side of the channel. In the setup the grinding wheel is arranged so that an axis of rotation of the grinding wheel forms an angle greater than 0° with a radial axis of the channel. A method of grinding a required profile in a body is also provided.

17 Claims, 3 Drawing Sheets

ARRANGEMENT FOR GRINDING AND A METHOD THEREOF

CROSS REFERENCE TO RELATED APPLICATIONS

This application claims priority of European Patent Office application No. 08009405.5.7 EP filed May 21, 2008, which is incorporated by reference herein in its entirety.

FIELD OF INVENTION

The invention relates to the field of grinding in industrial manufacturing processes. More particularly, the invention relates to grinding a required profile in a body.

BACKGROUND OF INVENTION

WO 2007/096295 A1 discloses a grinding wheel for grinding a required profile in the side of a channel that extends through a body, the wheel taking the form of a cup, the cup having a base and a wall that delimit the hollow of the cup, the wall being circular in form, the circular form of the wall being centered on the axis of rotation of the wheel, the exterior of the wall being abrasive and having a profile corresponding to the required profile in the side of the channel, in use of the grinding wheel a section of the wall being placed in the channel so that the abrasive exterior of the section bears against the side of the channel in which the profile is to be ground, grinding of the profile being achieved by rotation of the wheel.

SUMMARY OF INVENTION

The object of the present invention is to provide an improved arrangement for grinding a required profile in a body.

This object is achieved by an arrangement for grinding a required profile comprising:

a body comprising at least one channel extending into the body, and a grinding wheel adapted to grind the required profile in the side of the channel;

the grinding wheel being arranged in a way that an axis of rotation of the grinding wheel forms an angle greater than 0 degree with a radial axis of the channel.

This object is achieved by providing a method of grinding a required profile in a body comprising:

arranging a grinding wheel in a way that an axis of rotation of the grinding wheel forms an angle greater than 0 degree with a radial axis of a channel in the body, and rotating the grinding wheel for grinding the required profile in the side of the channel that extends into the body.

The invention is based on the observation that most profiles to be ground in a body do not contain any flank perpendicular to the radial axis of the channel in the body. The invention makes use of this by arranging the grinding wheel in a way that the axis of rotation of the grinding wheel forms an angle greater than 0 degree with the radial axis of the channel in the body. This results in an optimum clearance of the wheel with respect to the channel so that the grinding wheel can enter the channel and grind the required profile more easily. This allows a wider range of root designs to be ground. Also the availability of the extra clearance space gives a chance to use grinding wheels having lesser diameter and lesser thickness.

In a preferred embodiment of the invention, the angle is between 5 and 85 degrees. This enables the wall of the grinding wheel with the required profile to enter more easily the slot for grinding. The angle helps the inside diameter of the wheel to clear the outer edges of the channel.

In a further preferred embodiment of the invention, the body is a central disc of a turbine and the channel is a slot in the periphery of the body for accommodating a root part of a turbine blade of the turbine. This enables the slots to act as a retention mechanism, by holding the blade roots. The slot has a convoluted profile for receiving a complementary root of a blade. This helps in securing the blade roots to the disc against centrifugal forces associated with rotation of the disc about its axis.

In another alternative embodiment the grinding wheel is arranged in a way that the required profile in the side of the channel comprises one or more flanks positioned substantially perpendicular to the axis of rotation. Thus the angle between the axis of rotation of the grinding wheel and the radial axis of the channel in the body is chosen in a way that the one or more flanks of the profile are positioned substantially perpendicular to the axis of rotation. This enables the grinding wheel to enter the channel with optimum clearance space to grind the body.

BRIEF DESCRIPTION OF THE DRAWINGS

The present invention is further described hereinafter with reference to preferred embodiments shown in the accompanying drawings, in which.

DETAILED DESCRIPTION OF INVENTION

The grinding arrangement is explained with respect to an embodiment of the invention related to turbine disk root slot manufacturing. In turbo-machines such as gas turbine engines, the blades of fan, compressor, and turbine sections are attached to separate discs. These attachments involve providing blade roots having a convoluted section complementary to a convoluted section of slots in the disc periphery. In order to secure the blades to the disc, a series of slots must be cut in the periphery of the disc to accommodate root parts of the blades. The slots cut must have a profile corresponding to the profile of the root part of the blades. Generally a required profile is formed from an approximately similar roughened profile of the blade slot already provided in the turbine disc which was formed using conventional grinding wheels or cubic boron nitride (CBN)/Diamond grinding wheels. The configuration involving a convoluted profile that generally increases in transverse dimension from the slot base towards its opening is called a fir tree configuration. Pressure flanks are formed in the sides of the slot which helps in retaining the turbine blades under pressure.

Figure 1:
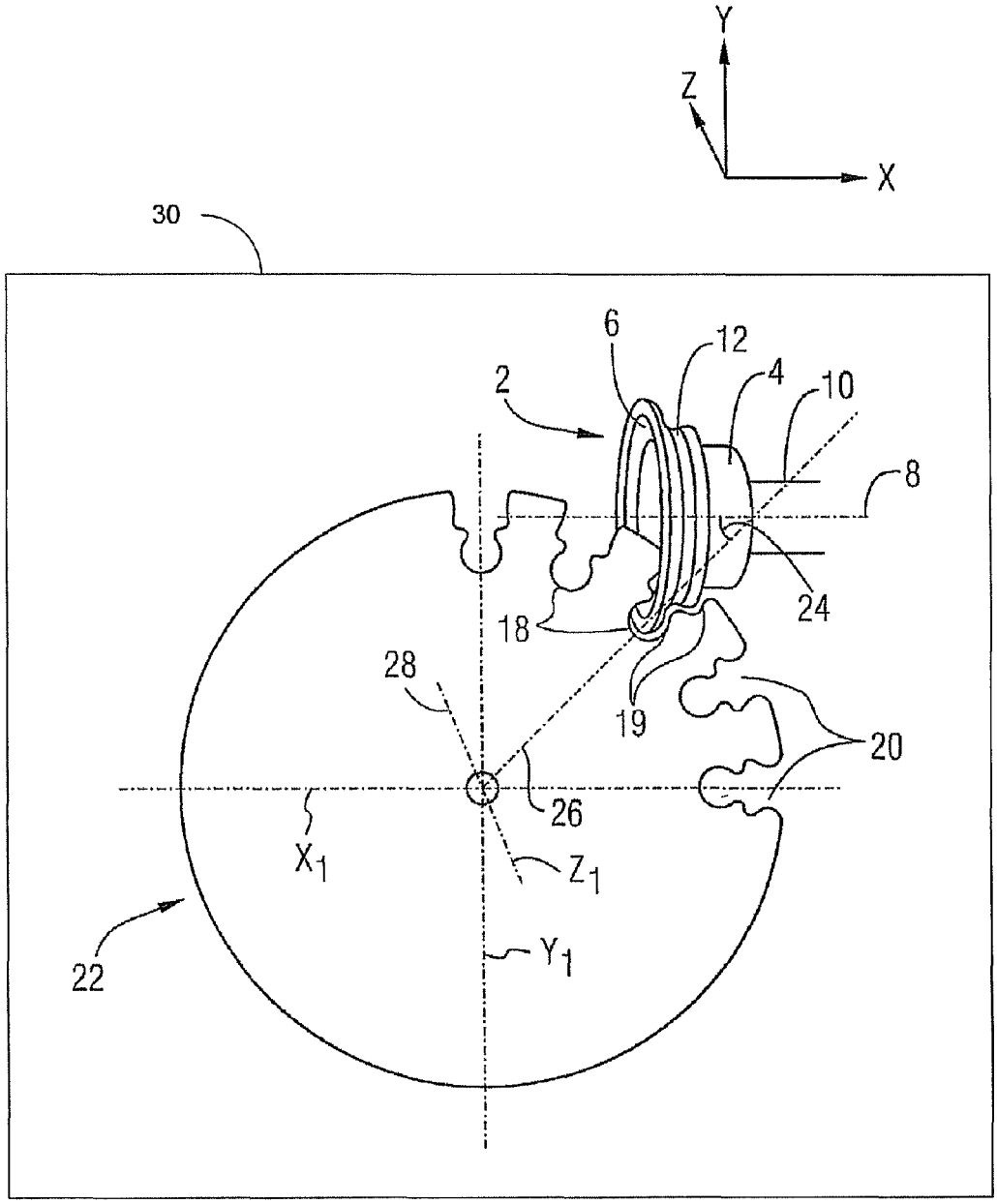
FIG. 1 is a perspective view of a grinding wheel in accordance with an embodiment of the present invention being used to cut turbine blade root slots in the central disc of a turbo-machine.

FIG. 1 is a perspective view of a grinding wheel 2 in accordance with an embodiment of the present invention being used to cut turbine blade root slots 20 in the central disc of a grinding turbo-machine 30. Typically the grinding wheel 2 takes the form of a cup, the cup having a base 4 and a wall 6 that delimit the hollow of the cup. The wall 6 is circular in form, its circular fowl being centered on the axis 8 of rotation of the grinding wheel 2. The centre of the exterior of base 4 is connected to a hub 10 that enables grinding wheel 2 to be rotated about axis 8. The wall 6 has an exterior 12 formed so as to have a profile corresponding to the required profile. The exterior 12 is coated with an abrasive material such as cubic boron nitride (CBN) or polycrystalline diamond (PCD). Formation of a turbine blade root slot 20 first involves forming a channel 18 using a conventional grinding wheel or Electrical Discharge Machining (EDM). The sides of the slot are then finished using a grinding wheel 2 as described here. For enabling the sides of the channel 18 to get the required profile the grinding wheel 2 is positioned in a way that the axis of rotation 8 of the grinding wheel 2 forms an angle 24 greater than 0 degree with a radial axis 26 of the channel 18 in the body 22, the body 22 in this embodiment being the central disc of the turbo-machine. The channel 18 extends along a symmetrical radial axis 26 which extends from the central longitudinal axis 28. The optimum angle 24 preferably lies between 5 degree and 85 degree to obtain the maximum advantage. This will result in an optimum clearance for the grinding wheel 2 with respect to the interior sides of the channel 18. The idea here is that the lower pressure flanks 19 of the body 22 are as close vertical as possible (almost parallel to Y axis in FIG. 1) but not past vertical. The lower pressure flanks 19 cannot be positioned past vertical as an overhang would be created which could not be ground.

Figure 2:
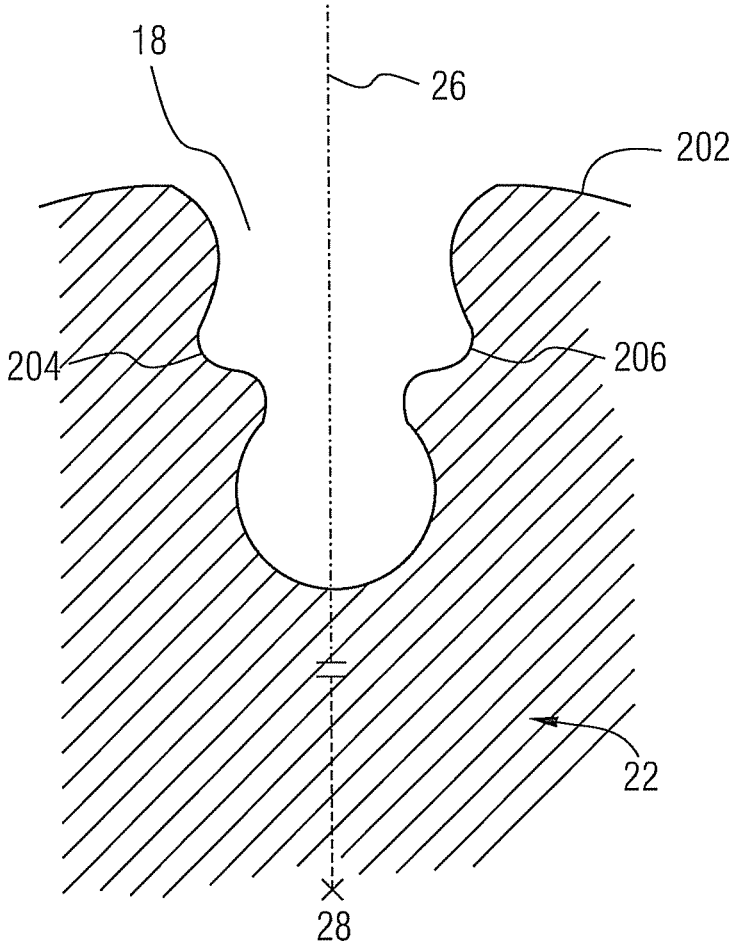
FIG. 2 is a radial cutaway view of the blade root slot.

FIG. 2 is a radial cutaway view of the channel 18. The body 22 has a central longitudinal axis 28 and a circumferential perimeter 202. Extending radially inward from the perimeter 202 is a channel 18 prior to becoming a turbine blade root slot 20 having the required profile, in the shown embodiment the slot being a fir tree blade attachment slot. The channel 18 is defined by sides 204 and 206. The channel 18 extends along a symmetrical radial axis 26 which extends from the central longitudinal axis 28.

Figure 3:
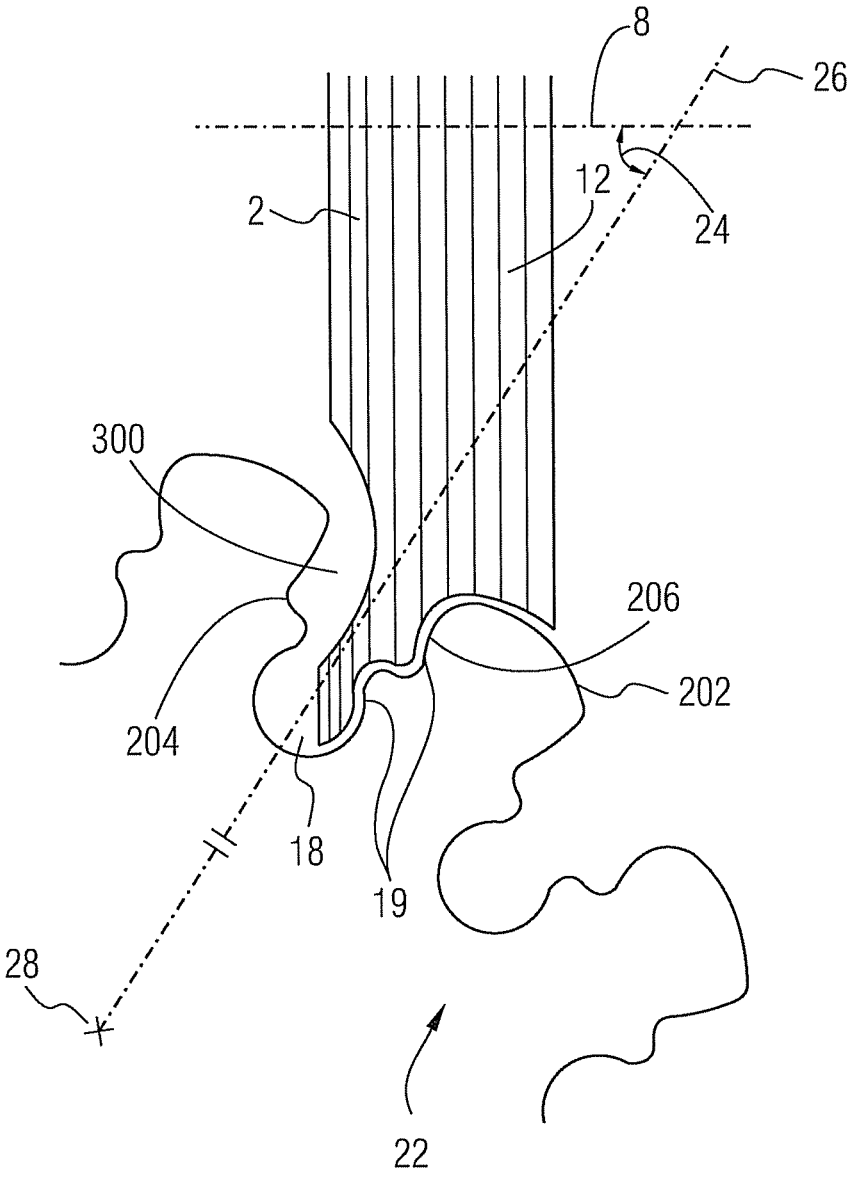
FIG. 3 is a radial cutaway view of the blade root slot during grinding.

FIG. 3 is a radial cutaway view of the channel during grinding. Shown is the body 22 having a central longitudinal axis 28 and a circumferential perimeter 202. Extending radially inward from the circumferential perimeter 202 is a circumferential array of channels 18 each defined by sides 204 and 206. A portion of the wall 6 of the grinding wheel 2 is arranged as shown. A portion of the wall 6 of the grinding wheel 2 is placed in the channel 18 so that the abrasive exterior 12 of the wall 6 bears against the side 206 of the channel 18 in which the profile is to be ground. The wall 206 of the channel 18 is shown comprising pressure flanks 19. The grinding can be enabled by rotating the grinding wheel 2 about an axis 8. The grinding wheel 2 is arranged in a way that an axis of rotation 8 of the grinding wheel forms an angle 24 greater than 0 degree (preferably between 5 degree and 85 degree) with a radial axis 26 of the channel 18. This provides an optimum clearance 300 between the grinding wheel 2 and the side 204. The grinding results in a blade root slot 20 forming a desired profile for receiving a complementary root of a blade.

Positioning of the grinding wheel 2, positioning of the body 22, rotation of the grinding wheel 2, and movement of the grinding wheel 2 along a channel 18 to grind a side of the channel, may all conveniently be carried out by use of a standard five axis grinding machine. The five axes concerned are: (i) translational movement of wheel 2 horizontally in FIG. 1, see axis X in FIG. 1; (ii) translational movement of grinding wheel 2 vertically in FIG. 1, see axis Y in FIG. 1; (iii) translational movement of wheel 2 into and out of the paper in FIG. 1, see axis Z in FIG. 1; (iv) positioning of body 22 about vertical axis Y1 in FIG. 1 (i.e. body 22 may be rotated about axis Y1 to enable it to be moved to various positions about axis Y1); and (v) positioning of body 22 about axis Z1 in FIG. 1, axis Z1 being into and out of the paper (i.e. body 22 may be rotated about axis Z1 to enable it to be moved to various positions about axis Z1 (this is the same central longitudinal axis 28 from which the radial axis 26 of the channel extends from)).

Summarizing, the invention relates to an improved grinding arrangement for grinding a required profile in a body. The arrangement comprises a body 22 comprising at least one channel 18 extending into the body 22, and a grinding wheel 2 adapted to grind the required profile in the side 206 of the channel 18. The grinding wheel 2 is arranged in a way that an axis of rotation 8 of the grinding wheel 2 forms an angle 24 greater than 0 degree with a radial axis 26 of the channel 18.

Although the invention has been described with reference to specific embodiments, this description is not meant to be construed in a limiting sense. Various modifications of the disclosed embodiments, as well as alternate embodiments of the invention, will become apparent to persons skilled in the art upon reference to the description of the invention. It is therefore contemplated that such modifications can be made without departing from the spirit or scope of the present invention as defined.

The invention claimed is:

1. An arrangement for grinding a side of a channel to a required profile, the arrangement comprising:

a body comprising a channel extending into the body, the channel having a roughened profile; and a grinding wheel having a grinding wheel profile that matches the required profile, wherein the grinding wheel is arranged so that an axis of rotation of the grinding wheel forms an angle between 5° and 85° with a radial axis of the channel when grinding the required profile.

2. The arrangement as claimed in claim 1, wherein the body is a central disc of a turbine and the channel is a slot in the periphery of the body for accommodating a root part of a turbine blade of the turbine.

3. The arrangement as claimed in claim 2, wherein the grinding wheel is arranged so that the required profile comprises a flank positioned substantially perpendicular to the axis of rotation.

4. The arrangement as claimed in claim 1, wherein the body is a central disc of a turbine and the channel is a slot in the periphery of the body for accommodating a root part of a turbine blade of the turbine.

5. The arrangement as claimed in claim 1, wherein the grinding wheel is arranged so that the required profile comprises a flank positioned substantially perpendicular to the axis of rotation.

6. The arrangement as claimed in claim 1, wherein the grinding wheel is arranged so that the required profile comprises a flank positioned substantially perpendicular to the axis of rotation.

7. A five axis grinding machine comprising the arrangement of claim 1.

8. The arrangement of claim 1, wherein the required profile comprises a pressure flank.

9. A method of grinding a required profile in a body, comprising:

arranging a grinding wheel so that an axis of rotation of the grinding wheel forms an angle between 5° and 85° with a radial axis of a channel in the body, wherein the channel has a previously formed roughened profile; and rotating the grinding wheel for grinding the roughened profile into the required profile in the side of the channel that extends into the body.

10. The method as claimed in claim 9, wherein the body is a central disc of a turbine and the channel is a slot in the periphery of the body which accommodates a root part of a turbine blade of the turbine.

11. The method as claimed in claim 10, wherein the grinding wheel is arranged so that the required profile comprises a flank positioned substantially perpendicular to the axis of rotation.

12. The method as claimed in claim 9, wherein the body is a central disc of a turbine and the channel is a slot in the periphery of the body which accommodates a root part of a turbine blade of the turbine.

13. The method as claimed in claim 9, wherein the grinding wheel is arranged so that the required profile comprises a flank positioned substantially perpendicular to the axis of rotation.

14. The method as claimed in claim 9, wherein the grinding wheel is arranged so that the required profile comprises a flank positioned substantially perpendicular to the axis of rotation.

15. The method as claimed in claim 9, wherein the grinding wheel is installed in a five axis grinding machine.

16. The method as claimed in claim 9, wherein the required profile comprises a pressure flank configured to oppose outward movement along the radial axis of a component disposed in the channel, and wherein the axis of rotation is substantially perpendicular to the pressure flank.

17. An arrangement for grinding a side of a channel to a required profile, the arrangement comprising:

a body comprising a channel extending into the body, the channel having a roughened profile; and a grinding wheel having a grinding wheel profile that matches the required profile, wherein the grinding wheel is arranged so that an axis of rotation of the grinding wheel forms an angle between 5° and 85° with a radial axis of the channel, wherein the required profile comprises a pressure flank configured to oppose outward movement along the radial axis of a component disposed in the channel, and wherein the axis of rotation is substantially perpendicular to the pressure flank.

* * * * *